US005896984A

United States Patent [19]

Focke et al.

[11] Patent Number: 5,896,984

[45] Date of Patent: Apr. 27, 1999

[54] HINGE-LID PACKET FOR CIGARETTES

[75] Inventors: Heinz Focke, Verden; Henry Buse, Visselhövede, both of Germany

[73] Assignee: Focke & Co. (GmbH & Co.), Verden, Germany

[21] Appl. No.: 08/960,225

[22] Filed: Oct. 29, 1997

[30] Foreign Application Priority Data

Oct. 29, 1996 [DE] Germany ..... 196 44 759

[51] Int. Cl.[6] ..... A24F 15/00

[52] U.S. Cl. ..... 206/268; 206/273

[58] Field of Search ..... 206/265, 268, 206/271, 273, 443; 229/160.1

[56] References Cited

U.S. PATENT DOCUMENTS

| | | |
|---|---|---|
| 2,369,391 | 2/1945 | Ringler . |
| 4,215,783 | 8/1980 | VanderLugt, Jr. . |
| 4,948,038 | 8/1990 | Moeller . |
| 5,314,114 | 5/1994 | Stone . |
| 5,478,011 | 12/1995 | Pham . |

FOREIGN PATENT DOCUMENTS

| | | |
|---|---|---|
| 205766 | 12/1986 | European Pat. Off. . |
| 392737 | 10/1990 | European Pat. Off. . |
| 2540221 | 9/1976 | Germany . |
| 534616 | 4/1973 | Switzerland . |

*Primary Examiner*—David T. Fidel
*Attorney, Agent, or Firm*—Sughrue, Mion, Zinn, Macpeak & Seas, PLLC

[57] ABSTRACT

Hinge-lid packets, especially of the round-edge type, comprise packet portion (10) and lid (11) as well as collar (23). The closed position of a packet of this type is often unsatisfactory. A closing aid is therefore provided which consists of a closing tab (35) in the region of a collar front wall (24) on the one hand and a lid inner flap (36) on the inner side of a lid front wall (17) on the other hand. The closing members mentioned above move into a closed position, mutually interlocking.

5 Claims, 4 Drawing Sheets

HINGE-LID PACKET FOR CIGARETTES

BACKGROUND OF THE INVENTION

The invention relates to a hinge-lid packet for cigarettes or other objects, comprising a packet portion and a lid hinged to same in the region of a packet rear wall, as well as a collar, the front wall of which is connected to the packet portion in the region of a packet front wall, the collar protruding from the packet portion with a collar upper part and the collar front wall having a recess which is open downwards and delimits a collar strip above a closing edge formed by the packet front wall.

Fold-over packets, also known as hinge-lid packets, are a widespread type of packaging for cigarettes, but also for other objects. Hinge-lid packets consist of thin cardboard. In most cases, the collar is formed by a separate blank - likewise made of thin cardboard. A lower portion of the collar is anchored in the packet portion by gluing. The packet contents—a group of cigarettes—are generally surrounded by an inner wrapping of paper or tin foil and thus form a block of cigarettes filling the inner space of the hinge-lid packet.

On this type of packet, the closed position of the lid is frequently insufficiently precise after it has been used for the first time. This problem exists particularly on hinge-lid packets with rounded longitudinal edges (round-edged packet) or with bevelled or polygonal longitudinal edges (octagonal packet).

A large number of closing aids for the above-mentioned packets is known. The invention is likewise principally concerned with this theme.

SUMMARY OF THE INVENTION

The object underlying the invention is to propose a closing aid for hinge-lid packets which guarantees a precise closed position of the lid even after lengthy use and which, on the other hand, only requires slight deviations from a hinge-lid packet formed conventionally.

In achieving this object, the hinge-lid packet according to the invention is characterised by the fact that, in the region of the recess of the collar front wall, a closing tab is formed which is folded over against the collar front wall or against the collar trip and which, when the lid is closed, engages with an inner lid flap adjacent to a lid front wall on the inside.

The closing tab, which lies next to the collar front wall on the outside, engages with the lid inner flap when the lid is closed, in the sense of interlocking on a counter-edge of this lid inner flap.

According to the invention, the collar is configured conventionally—apart from the closing tab. The closing tab is applied as a narrow strip of material to a delimiting edge of the recess and is of smaller dimension than the recess. A narrow strip of material is folded over downwards against the front side of the collar strip, to form the closing tab. The lid inner flap is so designed that the closing members which are supported by one another, namely the closing tab on the one hand and the lid inner flap on the other hand, close the region of the collar strip, i.e. together correspond to the width or height of the collar strip.

Additional features of the invention relate to the development of the hinge-lid packet or of a blank for same, especially in the region of the lid, and to the development of the collar. embodiment of the invention is explained below with he aid of the drawings. These show:

DESCRIPTION OF PREFERRED EMBODIMENTS

Figure 1:
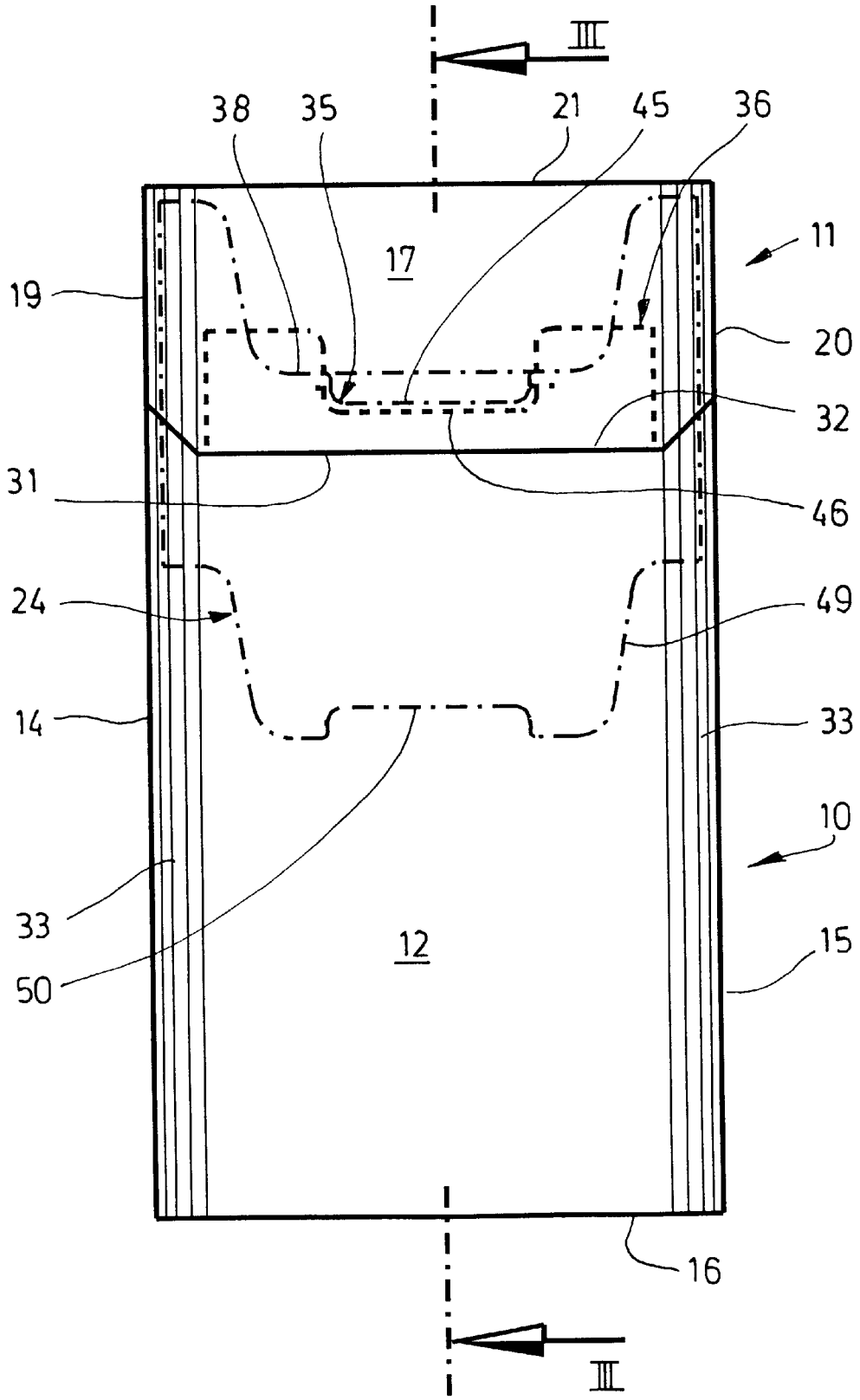
FIG. 1 a closed hinge-lid packet in front elevation.

A hinge-lid packet of a special shape, namely with round edges, is shown in the drawings as preferred embodiment, given by way of example. Other embodiments of hinge-lid packets can be designed analogously.

The hinge-lid packet consists of a packet portion 10 and a lid 11. These portions of the hinge-lid packet are connected to one another as one piece. The packet portion 10 is formed by a packet front wall 12, a packet rear wall 13, by packet side walls 14, 15 and a base 16. Similarly, the lid 11 consists of lid front wall 17, lid rear wall 18, lid side walls 19 and 20 and an upper end wall 21. The packet side walls 14, 15, and correspondingly the lid side walls 19, 20 are configured double-layered, consist namely of side flaps connected to one another by gluing.

Packet portion 10 and lid 11 are hinged to one another in the region of the packet rear wall 13 and the lid rear wall 18 through a transverse hinge line 22.

Figure 5:
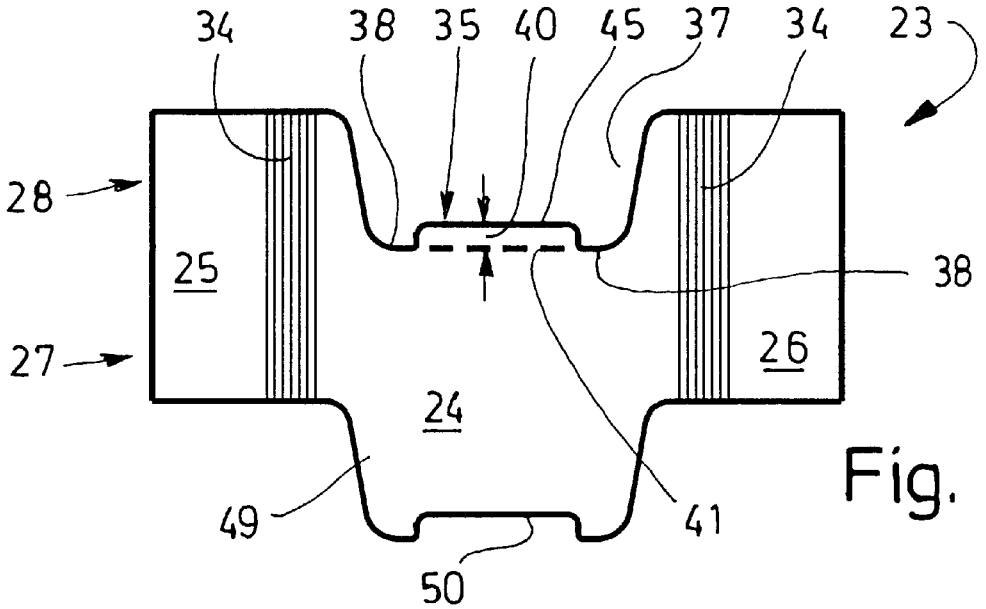

A collar 23 also forms part of the hinge-lid packet. This collar consists of a collar front wall 24 and collar side flaps 25, 26. The collar 23 consists here of a separate blank made of thin cardboard (FIG. 5). Alternatively, the collar can be connected to the blank of the hinge-lid packet as one piece. The collar 23 is positioned with a collar lower part 27 in the packet portion 10. The collar front wall is adjacent to the packet front wall 12 on the inside. The collar side flaps 25, 26 are adjacent to the packet side walls 14 and 15 on the inside. The collar 23 is connected to the packet portion 10 by gluing. A collar upper part 28 protrudes from the packet portion 10.

In the present case, a group of cigarettes 29 is provided as packet contents. These are surrounded by an inner wrapping made of paper or tin foil and thus form a block of cigarettes 30 as packet contents.

In the closed position, the lid 11 encloses the upper part 28 of the collar. An upper delimitation of the packet portion 10 forms a closing edge 31. In the closed position, a lower edge 32 of the lid front wall 17 is adjacent to the closing edge 31 of the packet portion 10. The closing edge and the lower edge 32 run sloping upwards in the region of the packet side walls 14, 15 or lid side walls 19, 20.

Upright packet edge 33 both of the packet portion 10 and of the lid are rounded, adapting to the dimensions of the cigarettes 29. Upright collar edges 34 are also configured correspondingly rounded (quarter circle).

Figure 4:
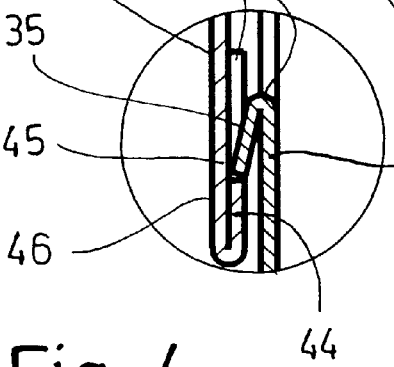
Figure 3:
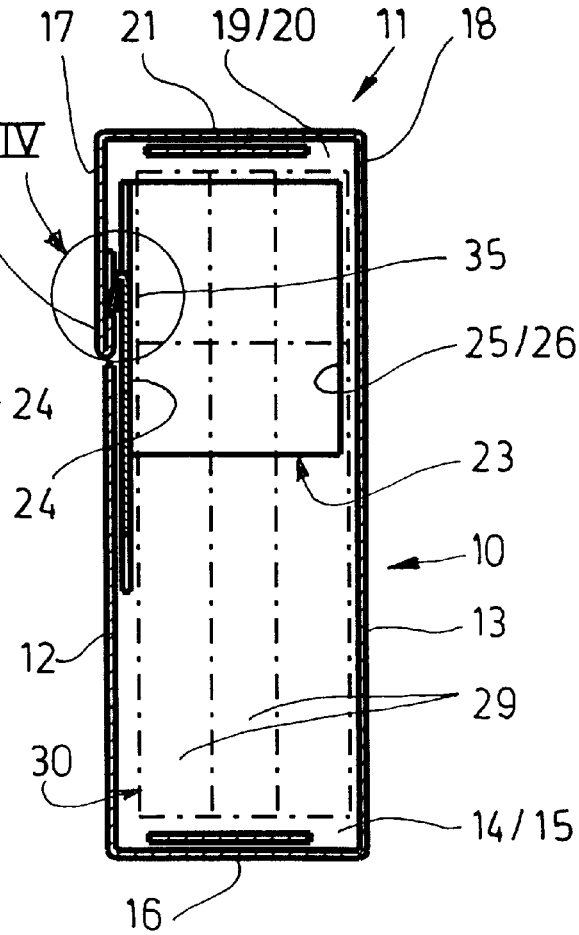

A closing aid becomes effective in the closed position of the lid 11. This aid consists of a closing tab 35 on the packet portion 10 or on the collar front wall 24 and of a counter-member on the lid 11, this being a lid inner flap 36. Closing tab 35 and lid inner flap 36 engage with one another as a form-fit in the closed position of the lid 11, in the sense of mutual interlocking (FIG. 3, FIG. 4).

The closing tab 35 is so disposed and configured that it is not necessary to change the design of the collar 23 in relation to traditional configurations. The collar 23 is usually provided in the region of the collar front wall 24 with a trough-like recess 37 which is open upwards. This is intended to make it easier for cigarettes to be removed when the hinge-lid packet is used. A delimiting edge of the recess 37 runs in a curve and forms as lower central delimitation of the recess 37 a horizontal or transverse edge section 38. This section runs roughly parallel to the closing edge 31 of the packet front wall 12. Between this closing edge 31 and the edge section 38, the collar front wall 24 forms a collar strip 39 which, because of the design of a hinge-lid packet, has a specific pre-determined height or breadth which is usually roughly 6 to 7 mm.

The closing tab 35 is formed as part of the closing aid on the collar front wall 24 in the region of the edge section 38 and connected to same. In its initial position (FIG. 5), the closing tab 35 projects into the recess 37. The closing tab 35 is, however, clearly shorter (measurement in the direction of the edge section 38) than this edge section 38. Also of significance is the fact that the closing tab 35 is only small in height 40, namely 3 mm to 4 mm. The closing tab 35 is delimited from the collar front wall 24 by a fold line 41 extending in prolongation of the edge section 38. This fold line can be configured as a perforation line in order to make it easier to fold the closing tab 35 over. In its effective position, the closing tab 35 is namely folded over against the outer side of the collar front wall 24 (FIG. 3, FIG. 4). In this process, the closing tab 35 is preferably directed at an acute angle to the collar front wall 24. The length of the closing tab is 25 mm, for example. As a counterpart of the closing aid, the lid inner flap 36, at least in an interlocking region, has a very small transverse measurement, namely approximately 3 mm to 4 mm. In the closed position of the lid, the lid inner flap 36 lies below the closing tab 35 in such a way that lid inner flap 36 and closing tab 35 interlock (FIG. 3, FIG. 4). The dimensions of the closing tab 35 and the lid inner flap 36 are here matched to one another such that together, i.e. adjacent to one another (FIG. 3, FIG. 4), they correspond to the height or width of the collar strip 39.

Figure 6:
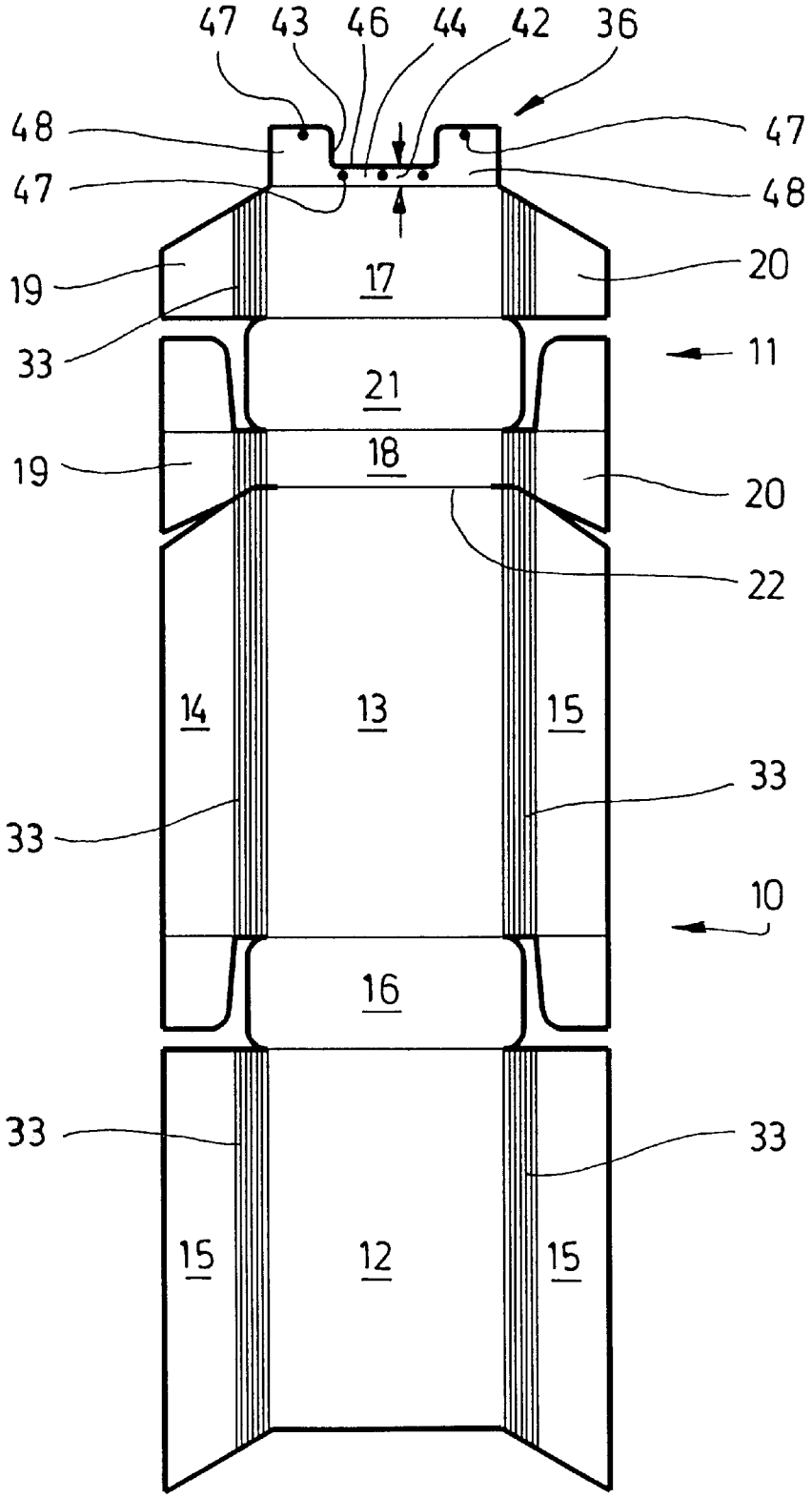

In the advantageous embodiment shown here, the lid inner flap 36 is provided in the central region with a depression 43. In the transverse direction of the blank (FIG. 6), this depression has a measurement which is somewhat greater than the length of the closing tab 35. In this way, a central region of the lid inner flap 36 is produced with a clearly reduced transverse measurement. This region cooperates as interlocking portion 44 with the closing tab 35. The latter forms a transverse supporting edge 45 pointing downwards. In the closed position, this edge is adjacent to the counter-edge 46, directed upwards, of the lid inner flap 36 or of the interlocking portion 44. Because of its sloping position, the closing tab enters the depression 43 of the lid inner flap 36. In this way the lid 11 is anchored on the collar 23 as a form-fit. When the lid 11 is closed, a snap-in effect is produced. When it is opened, there is only slight closing pressure to be overcome.

The lid inner flap 36 is anchored to the inner side of the lid front wall 17, this being done by gluing. In the present case, importance is attached to the fact that the interlocking piece 44 in particular is fastened securely and permanently to the lid front wall 17. To this end, glue spots 47 are provided as bonding means. In the region of the interlocking portion 44, three glue spots are here provided. Further glue spots 47 are located on the free edge of the lid inner flap 36 in the region of side enlargements 48.

The collar 23 is so configured that its blanks (FIG. 5) can be manufactured without waste from a continuous web of material in the width of the collar 23 through a transverse severance cut. A tongue 49, as is usual on a collar 23, directed downwards and in the size and shape of the recess 37, is provided at the lower end region with a cutout 50. This corresponds in form and size to the closing tab 35.

Figure 2:
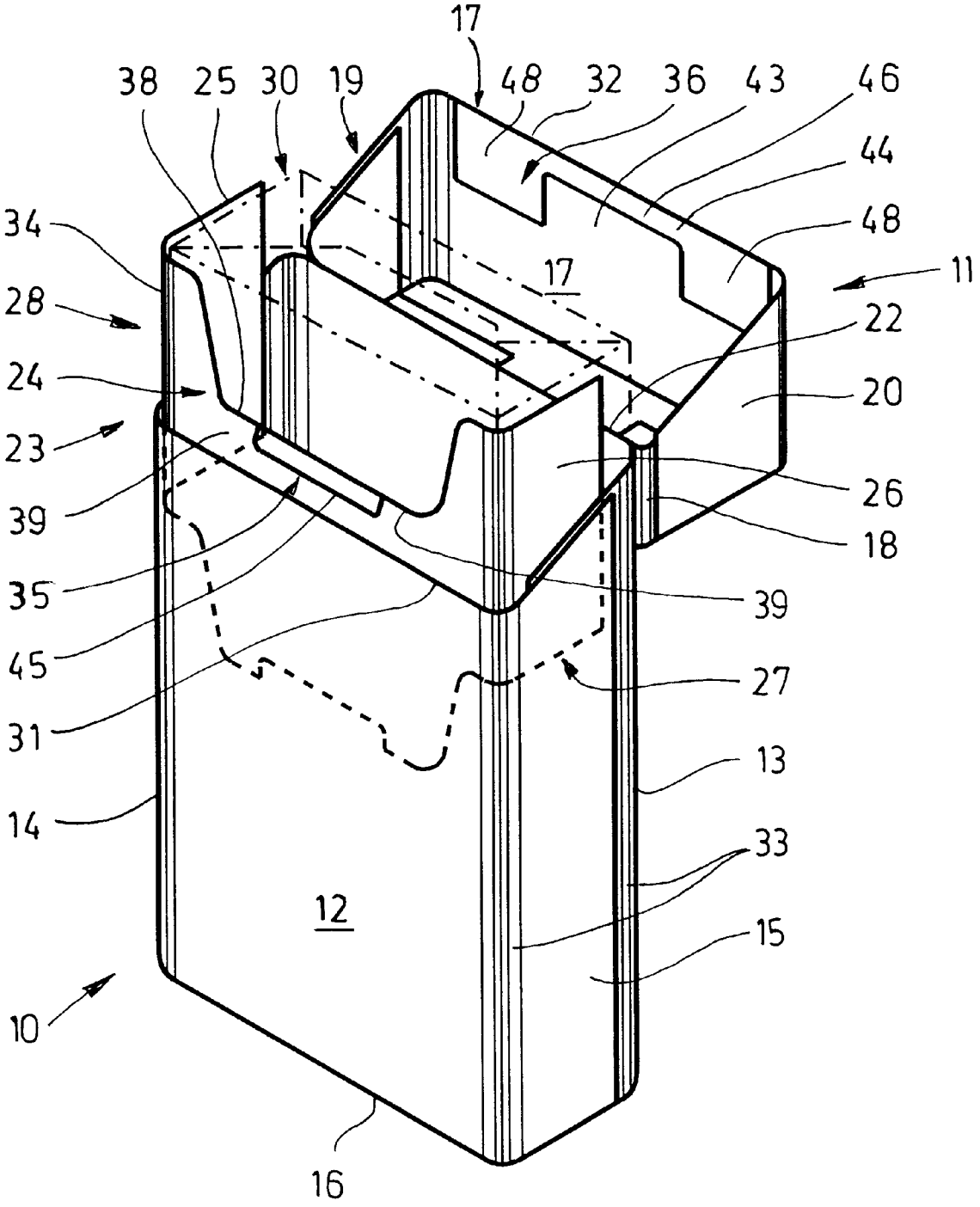
FIG. 2 the hinge-lid packet according to FIG. 1 in opened position and in perspective view, FIG. 3 the hinge-lid packet according to FIG. 1 in a vertical section, on a reduced scale, FIG. 4 a detail of the hinge-lid packet according to FIG. 3, on a greatly enlarged scale, FIG. 5 a blank for a collar, FIG. 6 a blank for the hinge-lid packet.

The packet can be finished in traditional fashion. The outer appearance, even in the opened position (FIG. 2), differs only slightly from a traditional hinge-lid packet.

We claim:

1. A hinge-lid packet for cigarettes (29), comprising:

a packet portion (10);

a lid (11) hinged to said packet portion in a region of a packet rear wall (13); and a collar (23) having a front wall (24) which is connected to the packet portion (10) in a region of a packet front wall (12), the collar (23) protruding vertically upwardly from the packet portion (10) with a collar upper part (28), and the collar front wall having a recess (37) which is upwardly open and defines a collar strip (39) above a closing edge (31) formed by a packet front wall (12); wherein:

a) in a region of the recess (37) of the collar front wall (24) there is a narrow, strip-shaped closing tab (35) which is folded over downwardly along a fold line thereof against said recess (37);

b) the closing tab (35), in a closed position of the lid (11), engages with a lid inner flap (36) adjacent to an inner side of a lid front wall (17);

c) the lid inner flap (36) is connected to the lid front wall (17) as one piece and is attached to the inner side thereof by glue, d) the closing tab (35) has a length which is less than the length of the recess (37) such that free edge sections (38) are formed as horizontal delimitations of the recess (37) on both sides of the closing tab (35) in prolongation of said fold line (41); and e) in the region of a closing catch of the closing tab (35), the lid inner flap (36) has a narrow, strip-shaped interlocking portion (44) having an exposed counter-edge (46) which engages with a supporting edge (45) of the closing tab (35); and f) the lid inner flap (36) has side enlargements (48) outside of the interlocking(, portion (44) which are connected to the inner side of the lid front wall (17) by glue.

2. The hinge-lid packet according to claim 1, wherein a height (40) of the closing tab (35) and a corresponding transverse dimension (42) of the interlocking portion (44) of the lid inner flap (36), together correspond approximately to a width of the collar strip (39).

3. The hinge-lid packet according to claim 1, wherein the lid inner flap (36) has a depression (43) that forms the interlocking portion (44), a dimension of said depression (43) in a longitudinal direction of the lid inner flap (36) being somewhat greater than a corresponding dimension of the closing tab (35), such that, in the closed position of the lid (11), the closing tab (35) enters the depression (43) of the lid inner flap (36).

4. The hinge-lid packet according to claim 1 wherein the lid inner flap is connected by a plurality of glue spots (47) to the inner side of the lid front wall (17), said glue spots (47) being arranged in a row besides one another in a region of said side enlargements (48).

5. The hinge-lid packet according to claim 1, wherein the collar (23) consists of a blank separate from that of the packet and lid, and has a downwardly directed tongue (49) containing a cutout (50) which corresponds in size and arrangement to the closing tab (35).

* * * * *